United States Patent [19]

Hills

[11] 4,450,855

[45] May 29, 1984

[54] REMOVABLE CONDENSATE COLLECTOR FOR ELEVATED WATER STORAGE FACILITIES

[75] Inventor: Richard E. Hills, Coraopolis, Pa.

[73] Assignee: Pittsburgh-Des Moines Corporation, Pittsburgh, Pa.

[21] Appl. No.: 361,136

[22] Filed: Mar. 24, 1982

[51] Int. Cl.[3] ..... E03B 11/00; E03B 9/00

[52] U.S. Cl. ..... 137/312; 92/103 F; 137/357; 222/108; 220/219

[58] Field of Search ..... 62/150, 272, 287, 331; 34/93; 92/103 F; 126/426, 450; 141/86; 220/1 B, 1 C, 219; 222/108; 137/312, 313, 357, 373; 203/DIG. 1, DIG. 22, 99; 261/108

[56] References Cited

U.S. PATENT DOCUMENTS

| | | | |
|---|---|---|---|
| 212,488 | 2/1879 | Mounteney | 92/103 F |
| 1,993,982 | 3/1935 | Wolfe | 222/108 |
| 3,213,639 | 10/1965 | Schumacher et al. | 62/287 |
| 3,337,418 | 8/1967 | Halacy, Jr. | 137/312 |
| 4,313,457 | 2/1982 | Cliff | 137/312 |

FOREIGN PATENT DOCUMENTS

| | | | |
|---|---|---|---|
| 226552 | 1/1960 | Australia | 92/103 F |

*Primary Examiner*—George L. Walton

*Attorney, Agent, or Firm*—Shoemaker and Mattare, Ltd.

[57] ABSTRACT

An improved removable condensate collector for elevated water storage facilities includes a membrane attached to the walls of such elevated water storage facility and positioned to prevent condensate from falling onto structures located at or near the bottom of the facility from a water storage container located at or near the top of the facility. The membrane can be frusto-conical in shape with the apex thereof located above or below the base, or can be horizontally disposed within the facility. The membrane is strengthened to support collected water thereon, until evaporation and ventilation remove that water from the storage facility.

14 Claims, 7 Drawing Figures

REMOVABLE CONDENSATE COLLECTOR FOR ELEVATED WATER STORAGE FACILITIES

BACKGROUND OF THE INVENTION

The present invention relates in general to elevated water storage facilities, and, more particularly, to improvements in condensate control in such facilities.

Elevated water storage facilities have a large interior volume which can be put to use in a manner disclosed in PDM Bulletin No. 103, dated April, 1971. Examples of such interior volume use include parking areas, office space, work areas, storage areas, shower areas attached to a work area, and the like. These areas can be insulated, lighted, air conditioned, or the like, as suitable.

All of the uses to which the interior volume of such elevated water storage towers are applied include the vertical partitioning of the interior volume by a ceiling structure. These ceilings can be acoustical ceilings or the like.

Condensation causes problems in such modified water storage towers. These problems arise because there is a mass of water overhead which is at approximately ground temperature. Because the water has been recently removed from the ground, or a reservoir, and pumped through underground piping, then stored in a container associated with such tower, this water is at or near a temperature of about 50° or 60° F., on the average. If the moisture content of the air inside the storage facility increases to a point where its dew point equals the temperature of the water stored in the container, moisture will begin to condense on the outside bottom of the container at the upper end of a riser. When sufficient condensation has occurred, water will begin to drip, and will drip onto anything which is stored at or near the base of the riser, such as offices or equipment, or the like.

This water can damage such equipment and stored items. Ceilings are also susceptible to such water damage.

Thus, there is need for a means of collecting the water before it drips onto equipment, or ceilings, or other elements located within the enclosure defined by the wall of an elevated water storage facility so that the water can be removed through a drain system to the outside of the enclosure. This permits storage of equipment and other uses of the building.

The structure disclosed in U.S. Pat. No. 4,313,457, issued on Feb. 2, 1982, is directed to this problem. However, this patented structure, while quite effective, can still be improved.

SUMMARY OF THE INVENTION

The structure embodying the teachings of the present invention is an improvement on the structure disclosed in U.S. Pat. No. 4,313,457, and prevents condensate formed on a water storage tank in an elevated water storage facility from falling onto elements located at or near the base of such facility. The disclosure of U.S. Pat. No. 4,313,457 is incorporated herein by reference thereto.

The structure disclosed herein includes a condensate collecting means mounted in the facility and positioned between the underside of a water storage tank and the bottom of the facility. Such collector is thus positioned between the water storage tank and any elements located within the facility near the bottom thereof.

The preferred form of the collector includes a downwardly converging frusto-conical membrane which is attached to the riser. Water collected in the membrane is retained on that membrane until evaporation causes the collected water to move from the membrane. Ventilation in the facility then removes the evaporated vapor from the facility.

The membrane is removably attached and thus renovation or modification of the facility is easily effected. A preferred form of the membrane includes a plurality of sections held together by watertight seams. The membrane is constructed of material which is designed and internally reinforced and/or strengthened to be able to collect and hold a volume of water for a period of time sufficient to permit evaporation into the air space above the collector and beneath the tank proper. Through movement of air through the structure, this vapor escapes from the structure.

Another form of the invention includes a collector membrane which is horizontally disposed.

OBJECTS OF THE INVENTION

It is a main object of the present invention to provide an improved means of preventing water damage of equipment located in an elevated water storage facility due to condensation formed on a water tank in such facility.

It is another object of the present invention to provide an improved means of preventing water damage of ceilings located in an elevated water storage facility due to condensation formed on a water tank in such facility.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
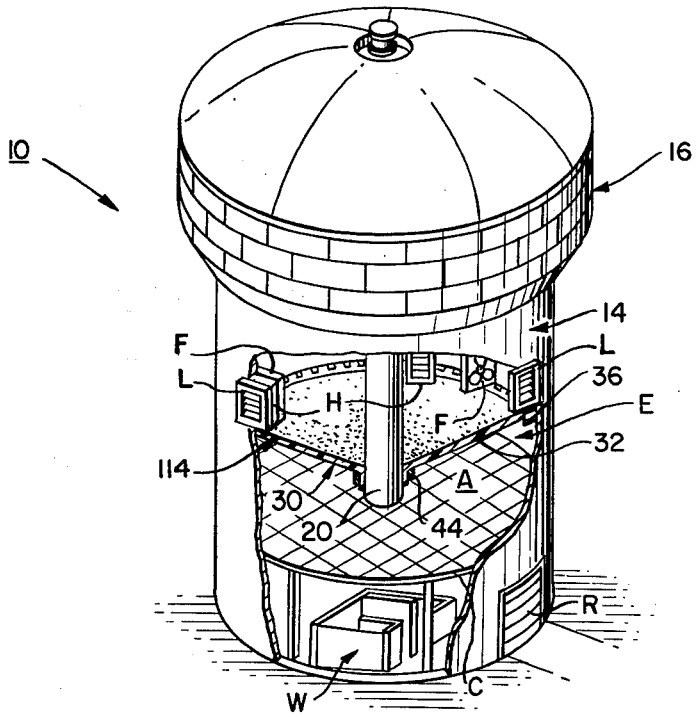
FIG. 1 is a perspective of an elevated water storage facility incorporating the condensation collector embodying the teachings of the present invention.

Shown in FIG. 1 is an elevated water storage tower 10 having a tank wall 14 based on a surface, such as the ground, a slab, or the like, supporting a water container 16 thereon. The tank wall defines an enclosed area E. Water is stored in the container 16 and passes through riser pipe 20. This water is often at a temperature in the range of 50° to 60° F., and thus condensate forms on the container lower surface located within the tank wall enclosure E when the conditions are proper. The condensate eventually falls off the container and falls downwardly toward the bottom of the tower under the influence of gravity.

As shown in FIG. 1, part of the enclosure E is partitioned off by a horizontally disposed ceiling C to define a work area W beneath the ceiling and an air space A above the ceiling. The work area can be a warehouse, parking garage, workshops, offices, storage areas or the like, or any combination thereof. The ceiling can be any type, such as an acoustical ceiling, or the like. Access doors and rolling door R can be placed in the tank wall 14.

Condensate falling from the water container 16 falls toward the ceiling C. Such condensate will collect on the ceiling, and eventually cause water damage to either the ceiling or to the materials contained in the enclosure E beneath the ceiling.

To prevent the falling condensate from ever reaching the ceiling, an improved condensate collector 30 is mounted between the container and the ceiling in the enclosure E.

Figure 2:
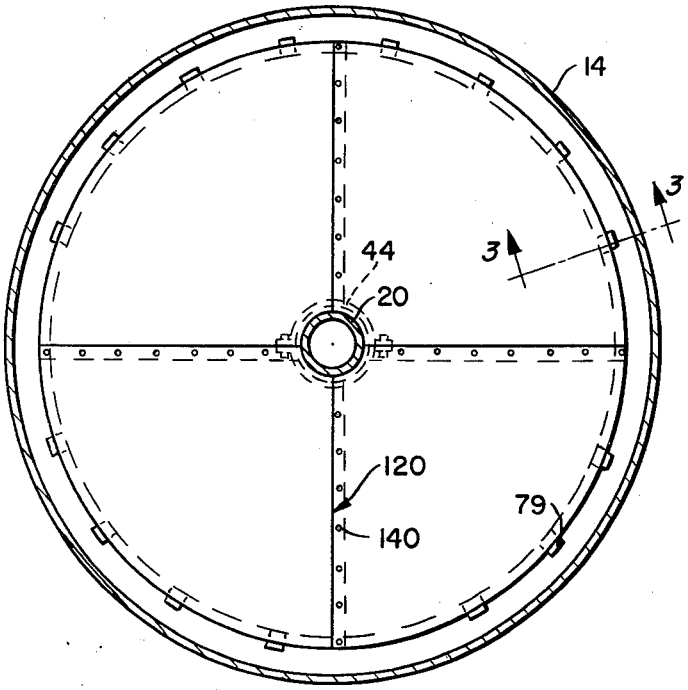
FIG. 2 is a plan view of an improved condensate collector embodying the teachings of the present invention.
Figure 3:
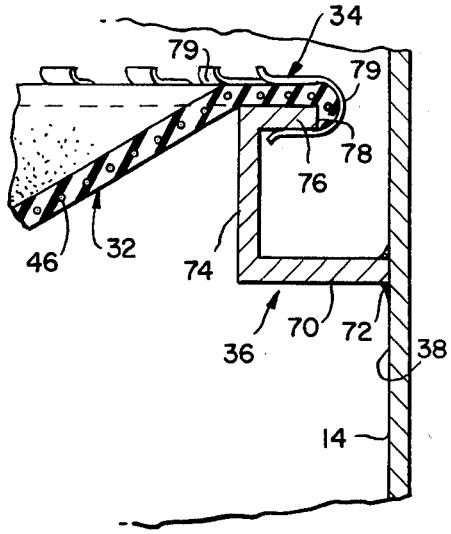
FIG. 3 is a view taken along line 3—3 of FIG. 2.

As best shown in FIGS. 1, 2 and 3, the condensate collector 30 includes a downwardly converging frusto-conically shaped membrane 32 attached at the base peripheral edge 34 thereof to a bracket 36 mounted on inner surface 38 of the tank wall 14, and mounted near the apex edge thereof to a harness 44 attached to the riser pipe 20. In the preferred form, the membrane has a slope of about 20° with the horizontal. Preferably, the membrane is a rubberized fabric, but can include fabric reinforcing means 46 within the body of the membrane material. The membrane can be designed to withstand a predetermined load and can thus include suitable material and/or stiffening means.

As humidity conditions occur and condensation begins to collect on the underside of the tank bottom, dripping water is collected by this new condensate ceiling. It merely puddles on the membrane and when more dry conditions occur, the air flowing through the structure evaporates this water and transports the vapor from the structure.

As best shown in FIG. 3, the preferred form of bracket 36 includes a base 70 attached at one edge thereof, as by welds 72, or the like, to the inner surface 38 of wall 14 and which extends inwardly of the enclosure. A wall 74 is integral with the base 70 and extends upwardly therefrom, and a top lip 76 is integral with the wall 74 and extends back toward the wall 14 and has a free edge 78 thereon.

The membrane 32 is folded over the top lip 76, and is attached thereto by a plurality of fasteners, such as clips 79, which may include Tinnerman clips (R), or the like.

As best shown in FIG. 2, the preferred form of the membrane 32 includes a plurality of sections, and in the preferred form, has four sections. The sections are coupled together to form the membrane 32 by seams 120. The seams extend radially along the membrane and abutting section edges overlap to form lap joints as discussed in the referenced patent. A plurality of fasteners 140 attach the overlapping edges together.

The seam fastener elements are preferably stainless steel, and the overlapping nature of the seam joints prevents leakage at the seams. Adhesive bonds can also be used to attach the membrane sections together.

Figure 4:
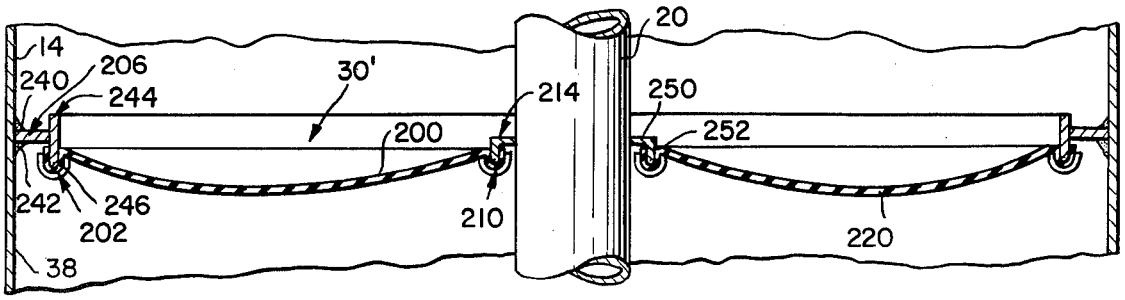
FIG. 4 is an elevation view of an alternative embodiment of the improved condensation collector embodying the teachings of the present invention.

An alternative embodiment of the condensate collector is shown in FIG. 4 and is indicated by the reference numeral 30'. The collector 30' includes an annular membrane 200 attached at an outer peripheral edge 202 thereof to a bracket 206 mounted on the inner surface 38 of the tank wall 14, and at an inner peripheral edge 210 thereof to a bracket 214 mounted on the riser pipe 20. The brackets 206 and 214 are approximately co-level so the peripheral edges of the membrane 200 are essentially co-level.

The membrane spans the area between the riser and the wall attached brackets and has a downwardly extending bulge 220 located approximately centrally thereof.

Condensate dropping from the water container 16 is intercepted by the collector 30' prior to that condensate falling onto a ceiling C and is held thereon until evaporation and ventilation remove such collected condensate from the structure.

Thus, like the collector 30, collector 30' prevents water damage to a ceiling C by preventing condensate from reaching that ceiling. The membrane 200 can be unitary or in sections which are connected together at seams using seam connectors such as discussed above and in the referenced patent. The bracket 206 includes a web 240 attached to the tank wall, as by welds 242, or the like, and which extends radially inward of the enclosure E. An upright flange 244 is attached to the web 240, and the membrane is attached to one edge, preferably lower edge 246, of the flange 244. The membrane is folded over the flange edge and is attached thereto by a plurality of clips, such as Tinnerman clips (r), or the like. Reinforcement washers can also be sandwiched between the clips and the membrane if so desired to further ensure leakage prevention.

The bracket 214 includes a base 250 attached, as by welds, or the like, to the riser pipe and which extends radially outward of the riser pipe. A flange 252 is integral with the base 250 and, in the FIG. 4, embodiment, extends downwardly to define an L-shape for the bracket 214. The inner edge 210 of the membrane 200 is attached to the bracket flange 252 in a manner similar to the attachment of the membrane edge 202 to the bracket 206 using clips or the like, and washers, if so desired, to define a water-tight attachment.

Figure 5:
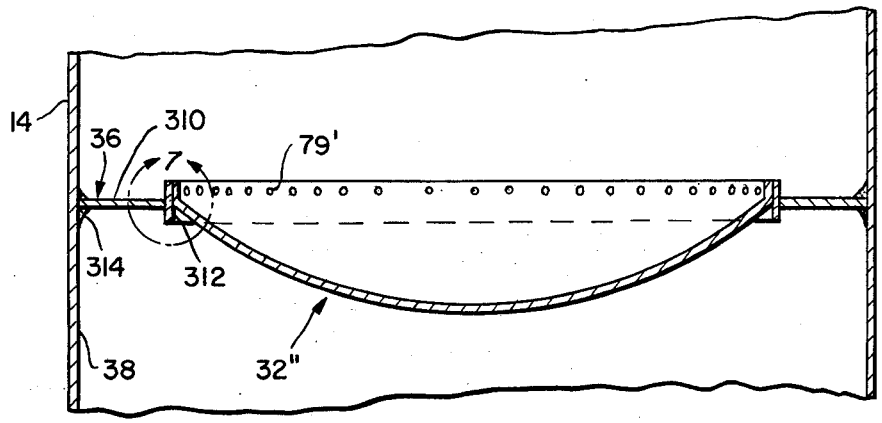
FIG. 5 is an elevation view of an alternative embodiment of the improved condensation collector embodying the teachings of the present invention.
Figure 6:
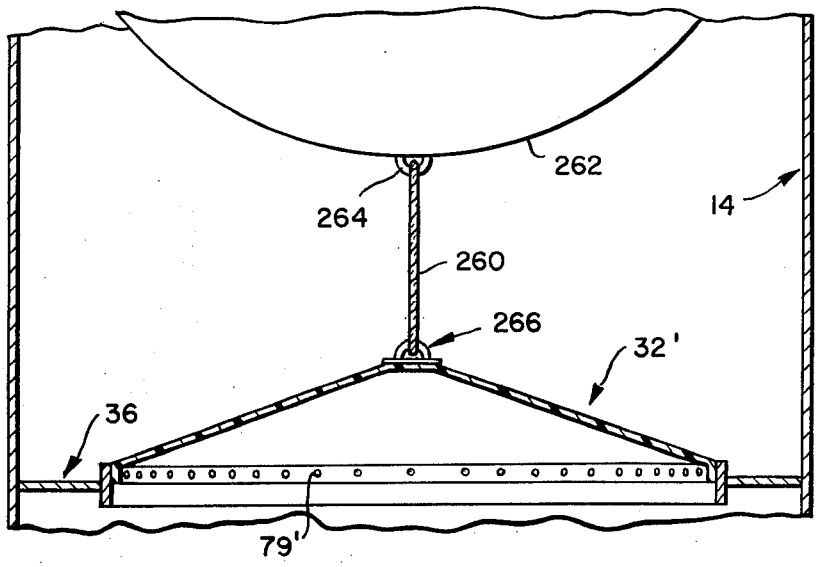
FIG. 6 is an elevation view of an alternative embodiment of the improved condensation collector embodying the teachings of the present invention.

The alternative embodiments shown in FIGS. 5 and 6 have a membrane mounted in a structure which does not include a centrally located riser such as riser 20 shown in FIGS. 1, 2 and 4. Thus, the alternative embodiment of the condensate collector shown in FIG. 6 includes a frusto-conical membrane 32' which is inverted with respect to the membrane 32 shown in FIG. 1, and such membrane has the bracket 36 forming the condensate collector and being located beneath the means supporting the apex section of the membrane. It is noted that in the FIG. 6 embodiment, the apex of the membrane is held high, as by cable 260 fixed to the underside 262 of the tank, or the like, by an anchor 264, or the like, and to the membrane by an erection lifting lug 266 on the membrane. The water drains to the bracket 36 where it collects and remains until evaporation and ventilation remove it from the facility.

The alternative embodiment of the improved condensate collector shown in FIG. 5 includes membrane 32'' attached to a bracket or stiffening ring 36 by bolts 79'. The membrane 32'' is hemispherically shaped with the highest point thereof attached to the stiffening ring, and the lowest point thereof located at or near the center of the water storage facility tank wall 14.

Figure 7:
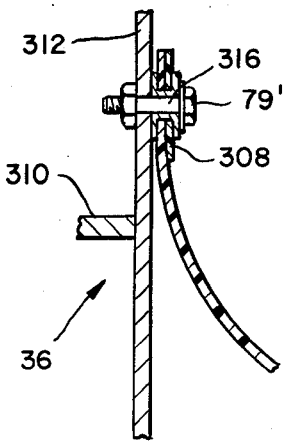
FIG. 7 is a view taken along line 7 of FIG. 5 and shows a bolted attachment of a membrane to a siffener ring mounted on a wall of the water storage facility.

The bolted connection between the membrane and the stiffener ring 36 is best shown in FIG. 7, and a washer 308 is interposed between the bolt and the membrane. The bracket 36 includes a web 310 and a flange 312 attached to the tank wall by welds 314 or the like. A bolt sleeve 316 is also included to protect the membrane. The bolted connection can be used with any of the membranes disclosed herein. The bolts can be grommets, if so desired. The membrane can be doubled over itself in place of the washer 308 if so desired.

Furthermore, a plurality of radially oriented cables can be angularly spaced about the facility 10 to help carry the weight of the membrane and/or the weight of the water collected on that membrane.

Suitable ventilation means 114 such as louvers L, fans F, heaters H, and the like can be included to facilitate ventilation through the structure.

The clips and other attachment means on all of the embodiments permit the condensate collectors to be easily removed when so desired. The removable nature of the collector facilitates renovation or alteration of the ceiling C and/or the work area W within the enclosure E, as well as rapid attachment of the membrane during a setup procedure.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. An improvement in an elevated water storage facility comprising: a water storage tank supported on top of an enclosed column and a partition extending across the column dividing the enclosed column into an air space above the partition and a work area for offices, warehouses, and the like located beneath the partition with elements located in the work area which can be damaged by condensate falling thereonto from the tank; collecting means for collecting condensed water vapor which drips from the underside of said tank, the collecting means including attaching means mounted on a wall of the enclosed column above the partition, a membrane attached to said attaching means and mounted inside the column at a location between the tank and the partition for collecting any condensate falling from the tank prior to that condensate falling onto the partition; and membrane strengthening means for internally reinforcing and strengthening the membrane to permit water collected on the membrane to be retained on the membrane for a period of time until evaporation and ventilation can remove that collected water from the elevated water storage facility; and ventilation means being disposed with the column and open to the outside atmosphere for facilitating ventilation through the facility to remove said collected water.

2. The improvement in an elevated water storage facility as defined in claim 1 wherein said strengthening means includes a rubberized fabric in the membrane, and said fabric having fabric reinforcing means therewithin.

3. The improvement in an elevated water storage facility as defined in claim 2 wherein said attaching means includes a mounting base attached by welding to the column wall and having a membrane attaching face spaced radially inward from the column wall, said membrane being attached to said attaching face so that said membrane is attached to said attaching means at a location spaced from the column wall.

4. The improvement in an elevated water storage facility as defined in claim 3 wherein said mounting base includes means for stiffening the column wall.

5. The improvement in an elevated water storage facility as defined in claim 1 further including an erection lifting lug mounted on said membrane.

6. An improvement in an elevated water storage facility which includes a water storage tank supported on top of an enclosed column, the column being divided into an air space and a work area for offices, warehouses, and the like with elements located in the work area which can be damaged by condensate falling thereonto from the tank,; collecting means for collecting condensed water vapor which drips from the underside of said tank, the collecting means including attaching means mounted on a wall of the enclosed column above the work area, a membrane attached to said attaching means and mounted inside the column at a location between the tank and the work area for collecting any condensate falling from the tank prior to that condensate falling into the work area;

membrane strengthening means for strengthening the membrane to permit water collected on the membrane to be retained on the membrane until evaporation and ventilation remove that collected water from the elevated water storage facility; and ventilation means being disposed with the column and open to the outside atmosphere for facilitating ventilation through the facility to remove said collected water.

7. The improvement in an elevated water storage facility as defined in claim 6, wherein said strengthening means includes a fabric in the membrane, said fabric further including reinforcing means therefor.

8. The improvement in an elevated water storage facility as defined in claim 7, wherein said fabric reinforcing means comprises stiffening means embedded in said fabric, said fabric furthermore being of rubberized construction.

9. The improvement in an elevated water storage facility as defined in claim 7, wherein said ventilation means for facilitating ventilation through the facility includes louvers.

10. The improvement in an elevated water storage facility as defined in claim 7, wherein said ventilation means for facilitating ventilation through the facility includes fans.

11. The improvement in an elevated water storage facility as defined in claim 7, wherein said ventilation means for facilitating ventilation through the facility includes heaters.

12. The improvement in an elevated water storage facility as defined in claim 6, wherein said ventilation means for facilitating ventilation through the facility includes louvers.

13. The improvement in an elevated water storage facility as defined in claim 6, wherein said ventilation means for facilitating ventilation through the facility includes fans.

14. The improvement in an elevated water storage facility as defined in claim 6, wherein said ventilation means for facilitating ventilation through the facility includes heaters.

* * * * *